United States Patent [19]

Abbé et al.

[11] 3,966,194

[45] June 29, 1976

[54] APPARATUS FOR MANIPULATING FINISHED REPRODUCTIONS IN COPYING MACHINES

[75] Inventors: Günter Abbé, Gilching; Rüdolf Eppe, Taufkirchen; Rüdiger Ettelbrück, Munich; Josef Pfeifer, Unterhaching; Günther Schnall, Eching, all of Germany

[73] Assignee: AGFA-Gevaert, A.G., Leverkusen, Germany

[22] Filed: Mar. 26, 1975

[21] Appl. No.: 562,243

[30] Foreign Application Priority Data

Mar. 28, 1974 Germany ..... 7410968[U]

[52] U.S. Cl. ..... 271/186; 271/DIG. 9

[51] Int. Cl.[2] ..... B65H 29/40

[58] Field of Search ..... 271/DIG. 9, 65, 173, 271/186, 207

[56] References Cited

UNITED STATES PATENTS

| | | | |
|---|---|---|---|
| 3,084,932 | 4/1963 | Schiller et al. | 271/186 |
| 3,646,325 | 2/1972 | George | 271/DIG. 9 |
| 3,700,231 | 10/1972 | Aasen et al. | 271/65 |
| 3,807,726 | 4/1974 | Hope et al. | 271/207 |
| 3,856,295 | 12/1974 | Looney | 271/DIG. 9 |

*Primary Examiner*—Evon C. Blunk
*Assistant Examiner*—Robert Saifer
*Attorney, Agent, or Firm*—Michael J. Striker

[57] ABSTRACT

A copying machine wherein successive finished sheets issue from an opening in the front wall of the housing in such positions that the printed matter is observable from above. Successive sheets pass below an observation window which is adjacent to the opening so that the quality of printed matter can be observed from above. The sheets are thereupon inverted so that the printed matter faces downwardly, and are stacked on top of each other in a tray having a bottom panel the inner end portion of which constitutes the observation window. The sheets are inverted in a channel having an inlet below the observation window and an outlet above the end of the tray which is remote from the opening.

6 Claims, 1 Drawing Figure

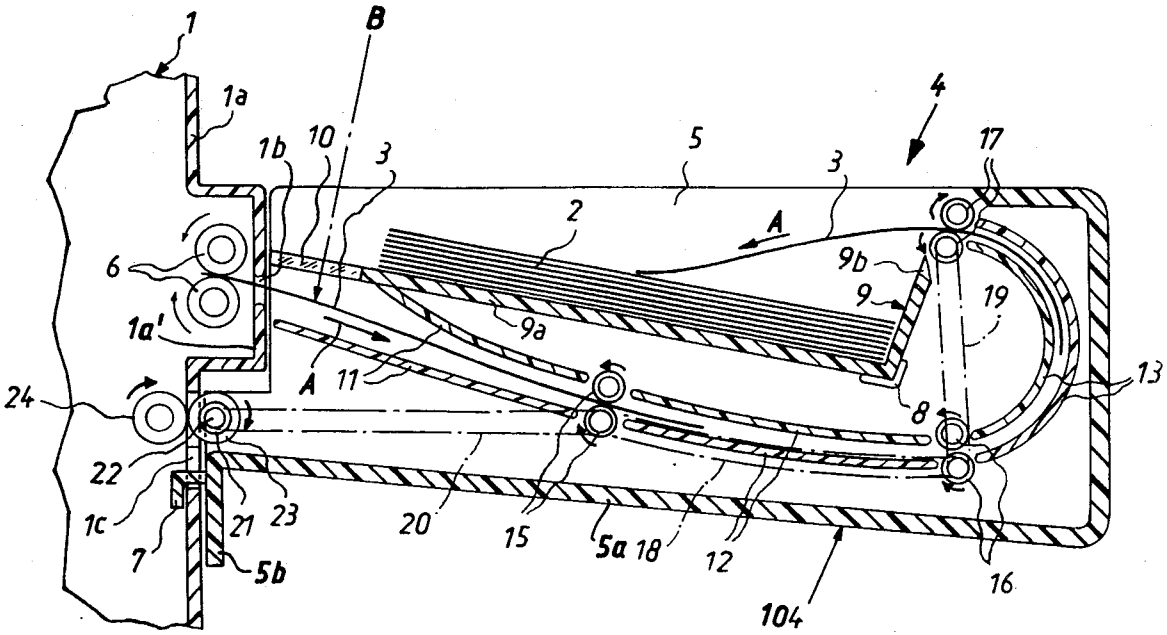
13
17
19
16
4
8
9b
9
3
A
104
5
12
18
5a
2
9a
15
20
B
3
10
11
A
1b
23
5b
1a
21
1
6
1a'
22
1c
7
24

APPARATUS FOR MANIPULATING FINISHED REPRODUCTIONS IN COPYING MACHINES

BACKGROUND OF THE INVENTION

The present invention relates to copying machines wherein flexible sheets are converted into finished reproductions each of which is provided with printed matter or other information, at least at one side thereof. More particularly, the invention relates to apparatus which is embodied in or associated with a copying machine and serves to manipulate finished reproductions, particularly to stack the reproductions on top of each other.

It is known to attach to a wall of the housing of a copying machine a tray or a like receptacle having an open top and serving to accumulate successive finished reproductions in such a way that the information on each reproduction of the stack faces upwardly. Thus, the reproductions are not stacked in the same sequence in which the originals are fed or placed into the copying machine. Consequently, each stack must be rearranged by hand or by a complex attachment so that finished reproductions are stacked in proper sequence, i.e., that the reproductions of successive pages of a book, brochure or the like are stacked in numerical order.

It is also known to mount an inverting device between the tray and the housing of the copying machine so that each finished reproduction is turned upside down before it enters the tray. This insures that the reproductions are stacked in proper sequence. However, presently known inverting devices for finished reproductions are mounted in such a way that they do not permit for observation of information on successive finished reproductions, i.e., the operator of the machine cannot determine whether or not each finished reproduction carries any information and/or whether or not the imprinted or otherwise applied information is satisfactory.

SUMMARY OF THE INVENTION

An object of the invention is to provide a novel and improved apparatus which forms part of or is connectable with a copying machine and is capable of manipulating finished flexible sheet-like reproductions in such a way that the quality, presence and/or absence of information on successive reproductions is observable as well as that the reproductions are stacked or otherwise assembled in proper sequence.

Another object of the invention is to provide a novel and improved inverting or turn-around device for use in the just outlined apparatus.

A further object of the invention is to provide a simple, compact and inexpensive apparatus which can assemble finished reproductions in proper sequence and allows for visual determination of the quality of information on successive finished reproductions.

An additional object of the invention is to provide a novel and improved combination of sheet-inverting and sheet-stacking means in or on a copying machine, such as a xerographic copying machine.

A further object of the invention is to provide an apparatus which can manipulate finished reproductions in the above outlined manner and can be rapidly detached from a copying machine, either in its entirety or to such an extent that it is not in the way when the machine is not in use.

Still another object of the invention is to provide a novel and improved tray or an analogous open-top receptacle for stacks of finished reproductions which issue from a copying machine.

The invention is embodied in an apparatus for manipulating preferably flexible sheet-like finished reproductions in a copying machine wherein at least one side of each finished reproduction is provided with information. The apparatus comprises means (e.g., a pair of driven rollers behind the discharge opening in the front wall of a copying machine) for advancing successive finished reproductions into an elongated path having successive first, second and third portions in the first of which the one side of each finished reproduction faces substantially upwardly so that the one side of each reproduction is observable from above for determination of the presence, absence and/or quality of information, means for inverting successive reproductions in the second portion of the path so that the one side of each inverted reproduction faces downwardly, and an open-top receptacle or tray or analogous means for stacking successive inverted reproductions on top of each other in the third portion of the path.

The apparatus preferably further comprises an observation window which is disposed above the first portion of the path and may constitute an integral or separable part of the bottom panel of the tray. In accordance with a presently preferred embodiment of the invention, the observation window is located between the advancing means and the stacking means, and at least a portion of the inverting means is preferably located below the stacking means.

The inverting means may include an elongated channel having pairs of rails or analogous guide means which define the first and second portions of the path, and the tray of the stacking means defines the third portion of the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a longitudinal vertical sectional view of an apparatus which forms part of a copying machine and embodies one form of the invention.

DESCRIPTION OF THE PREFERRED EMBODIMENTS

The drawing shows a portion of a copying machine 1 (e.g., a xerographic copying machine) having a housing including an upright supporting wall 1*a* (e.g., a front wall) which is formed with a discharge opening 1*b* for finished flexible reproductions such as sheets 3 of paper. The means for expelling successive sheets 3 through and beyond the discharge opening 1*b* of the supporting wall 1*a* and into an elongated path includes a pair of advancing rolls 6 which are installed in the housing of the copying machine 1 and whose nip is located immediately behind the discharge opening.

The wall 1*a* of the housing of the copying machine 1 supports a turn-around or inverting device 4 for successive finished sheets 3 and a forwardly and downwardly inclined receptacle or tray 9 which collects and stacks successive sheets 3 so that the imprinted sides of the sheets face downwardly. The inverting device 4 has a container 104 with two spaced-apart parallel side walls 5 which are disposed in vertical or nearly vertical planes and carry angular brackets 8 (only one shown) serving as supports for the front portion of the tray 9.

In accordance with a feature of the invention, that portion 10 of the bottom panel 9*a* of the tray 9 which is immediately or closely adjacent to the discharge opening 1*b* constitutes an observation window having a length (as considered at right angles to the plane of the FIGURE) which preferably equals the width of the bottom panel and a width (as considered in the direction of travel of successive sheets 3 through and beyond the discharge opening 1*b*, see the arrows A) which suffices to enable an attendant or another operator of the copying machine to observe the recorded information on successive sheets 3 while such sheets enter into the inverting device 4. The length of the panel 9*a* preferably exceeds the length of longest sheets 3 to be used in the copying machine 1 so that the sheets of the stack 2 in the tray 9 cannot overlie the observation window 10.

The container 104 of the inverting device 4 accommodates an elongated channel consisting of three pairs of suitably inclined guide rails 11, 12 and 13. The inlet of the channel is located below the window 10 and close to the discharge opening 1*b* so that a sheet 3 which issues from the housing of the copying machine 1 automatically enters the inlet of the channel and advances therein longitudinally to be inverted during travel between the guide rails 13 and to automatically descend onto the uppermost sheet of the stack 2 in the tray 9. That portion of the channel which is defined by the guide rails 11 and 12 is located below and is substantially parallel to the bottom panel 9*a* of the tray 9. The marginal portions of the guide rails 11, 12 and 13 are preferably inserted into suitable recesses or sockets of the side walls 5 forming part of the container 104.

The means for transporting successive sheets 3 along those (first and second) portions of an elongated path which are defined by the channel 11–13 comprises three pairs of driven rolls 15, 16 and 17. The rolls 15 are disposed between the guide rails 11, 12 and the rolls 16 are disposed between the guide rails 12, 13. The rolls 17 are mounted at the outlet of the channel, i.e., close to the upper end portions of the guide rails 13. Each of the guide rails 13 has a substantially semicircular shape. The lower roll 15 is driven by a belt, cord or an analogous endless flexible element 20 and drives the lower roll 16 through the medium of another endless flexible element 18. The lower roll 16 drives the lower roll 17 through the medium of a third endless flexible element 19. The shafts of the rolls 15–17 are journalled in one or both side walls 5 of the container 104. The flexible element 20 is driven by a pulley or sheave 21 which is mounted on a shaft 22. The shaft 22 further carries a friction wheel 23 which is the input element of the sheet transporting means and a portion of which extends into the interior of the housing of the copying machine 1 through an aperture 1*c* of the wall 1*a* and engages a driven friction wheel or output element 24. The wheel 24 and one or both advancing rollers 6 receive motion from the main prime mover (e.g., an electric motor, not shown) of the copying machine. The shaft 22 is rotatably mounted in one or both side walls 5. If desired, the friction wheels 23, 24 can be replaced by two gears which are in mesh when the container 104 is properly attached to the wall 1*a*.

The bottom wall 5*a* of the container 104 has a substantially vertical extension 5*b* which abuts against the outer side of the wall 1*a* below the aperture 1*c*. A hook-shaped coupling portion 7 of the extension 5*b* passes through the aperture 1*c* and abuts against the inner side of the wall 1*a* opposite the extension 5*b*. The lower portion of the aperture 1*c* is preferably wide, and the width of the coupling portion 7 (as considered in a direction at right angles to the plane of the drawing) is sufficient to insure that the container 104 is not likely to be tilted when the coupling portion 7 assumes the illustrated position. The friction wheel or gear 23 then meshes with the friction wheel or gear 24, and the inlet of the channel defined by the guide rails 11–13 is immediately adjacent to the discharge opening 1*b*, i.e., the window 10 is in an optimum position to allow for observation of information which is imprinted on successive sheets 3 issuing from the housing of the copying machine 1.

The operation is as follows:

Finished reproductions or sheets 3 are discharged from the housing of the machine face up, i.e., the recorded information is observable by looking downwardly (arrow B) through the window 10. Thus, an attendant or another person who operates the copying machine 1 is in a position to determine the presence, absence and/or quality of information on successive sheets 3 and to intercept a defective sheet before it lies flat against the preceding sheet of the stack 2. In the illustrated embodiment, the sheet 3 which is observable by looking through the window 10 is the one immediately following the sheet which is in the process of coming to rest on top of the stack 2. The window 10 may comprise a transparent or translucent pane made of glass or synthetic plastic material, or it may constitute a cutout in the rearmost or innermost portion of the bottom panel 9*a*. The inversion of successive sheets 3 takes place during travel in that (arcuate) portion of the channel which is defined by the guide rails 13. Since the container 104 is open at the top, the stack 2 or a discrete sheet 3 is readily accessible from above. The inclination of the bottom panel 9*a* may be so pronounced that the sheets 3 tend to slide forwardly (in a direction to the right, as viewed in the drawing) so as to abut against the front panel 9*b* of the tray 9. The upper edge of the front panel 9*b* is preferably closely or immediately adjacent to the lower transporting roll 17.

When the copying machine 1 is not in use, the entire inverting device 4, together with the tray 9 therein, can be detached from the wall 1*a* by the simple expedient of removing the coupling portion 7 from the aperture 1*c*. The extension 5*b* can be provided with two or more spaced apart coupling portions 7, i.e., one or more coupling portions can be located behind and/or in front of the illustrated coupling portion 7.

An important advantage of the improved apparatus is that it allows for observation of recorded information on successive sheets 3 even though the sheets are stacked face down, i.e., in the same sequence in which the corresponding originals are fed into the copying machine 1. This insures that a careful attendant can remove defective sheets 3 from the top of the stack 2 or even before a defective sheet reaches the stack.

Another important advantage of the apparatus is that it occupies little room, mainly because the tray 9 is located within the confines of the container 104 of the inverting device 4. However, and if the space is not at a premium, the tray 9 can be installed below the bottom wall 5*a* of the container 104 by the simple expedient of utilizing guide rails 13 which are curved downwardly from the right-hand ends of the guide rails 12, i.e., the guide rails 13 then extend downwardly from the guide rails 12 from a 12 o'clock position (rolls 16) to a 6 o'clock position below the rolls 16 where the outlet of the channel discharges sheets 3 into that (third) portion of the path which is defined by the tray. The container 104 is actually a simple frame which supports the tray 9, the observation window 10 and the component parts 11–13, 15–23 of the inverting device 4. If desired, the window 10 can be fixedly mounted on the portion 1*a'* of the wall 1*a* so that it remains permanently attached to the housing of the copying machine 1.

Without further analysis, the foregoing will so fully reveal the gist of the present invention that others can by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. Apparatus for manipulating sheet-like finished reproductions in a copying machine wherein at least one side of each reproduction is provided with information, comprising means for advancing successive finished reproductions into an elongated path having successive first, second and third portions in the first of which said one side of each reproduction faces substantially upwardly so that said one side is observable from above for determination of the presence, absence and/or quality of information; means for inverting successive finished reproductions in said second portion of said path so that said one side of each reproduction faces downwardly; means for stacking successive inverted reproductions on top of each other in said third portion of said path; and an observation window integral with said stacking means and located above said first portion of said path between said advancing means and said stacking means.

2. Apparatus as defined in claim 1, wherein at least a portion of said inverting means is located below said stacking means.

3. Apparatus for manipulating sheet-like finished reproductions in a copying machine wherein at least one side of each reproduction is provided with information, comprising a housing including a wall having a discharge opening for finished reproductions; advancing means located in said housing adjacent said discharge opening for advancing successive finished reproductions into an elongated path having successive first, second and third portions in the first of which said one side of each reproduction faces substantially upwardly so that said one side is observable from above for determination of the presence, absence and/or quality of information; inverting means for inverting successive finished reproductions in said second portion of said path so that said one side of each reproduction faces downwardly, said inverting means including a channel having guide means which defines said first and second portions of said path and a container for said guide means; and stacking means for stacking successive inverted reproductions on top of each other in said third portion of said path, said stacking means including a receptacle defining said third portion of said path and having the form of a tray mounted in said container at a level above a portion of said guide means and having an open top, said inverting and stacking means being located outside said housing.

4. Apparatus as defined in claim 3, wherein said inverting means further comprises a frame for said receptacle and for said guide means and means for coupling said frame to said wall.

5. Apparatus as defined in claim 4, wherein said receptacle has a light-transmitting portion which overlies said first portion of said path intermediate said discharge opening and a stack of reproductions in said receptacle.

6. Apparatus as defined in claim 3, wherein said inverting means further comprises means for transporting reproductions in said channel, and further comprising drive means for said transporting means, said drive means being mounted in said housing and having a rotary output element, said transporting means having a rotary input element receiving torque from said output element.

* * * * *